US006347432B1

(12) United States Patent
Kuo

(10) Patent No.: US 6,347,432 B1
(45) Date of Patent: Feb. 19, 2002

(54) LOCKING DEVICE FOR HANDLE ASSEMBLY

(75) Inventor: Chung-Hsien Kuo, Pan Chiao (TW)

(73) Assignee: Chaw Khong Technology Co., Ltd. (TW)

( * ) Notice: Subject to any disclaimer, the term of this patent is extended or adjusted under 35 U.S.C. 154(b) by 0 days.

(21) Appl. No.: 09/531,756

(22) Filed: Mar. 20, 2000

(30) Foreign Application Priority Data

Oct. 13, 1999 (TW) ..... 88217366 U

(51) Int. Cl.[7] ..... A45C 13/26
(52) U.S. Cl. ..... 16/113.1
(58) Field of Search ..... 16/113.1, 405, 16/429; 403/109.7, 109.1, 109.8, 109.2; 280/655, 655.1, 47.371; 190/18 A, 115

(56) References Cited

U.S. PATENT DOCUMENTS 5,414,895 A * 5/1995 Kazmark, Jr. ..... 16/113.1
5,458,020 A * 10/1995 Wang ..... 403/109.7
5,459,908 A * 10/1995 Chen ..... 16/113.1
5,542,150 A * 8/1996 Tu ..... 16/113.1
5,581,846 A 12/1996 Wang ..... 16/115
5,584,097 A * 12/1996 Lu ..... 16/113.1
5,628,088 A 5/1997 Chen ..... 16/115
5,639,109 A * 6/1997 Liang ..... 16/113.1
5,653,319 A * 8/1997 Wang ..... 16/113.1
5,694,663 A * 12/1997 Tserng ..... 16/113.1
5,727,898 A * 3/1998 Lu ..... 16/113.1
5,806,143 A * 7/1998 Tsai ..... 16/405
5,901,822 A * 5/1999 Tu ..... 16/113.1
5,909,760 A * 6/1999 Tsai ..... 16/429
5,951,037 A * 9/1999 Hsieh et al. ..... 280/655

* cited by examiner

*Primary Examiner*—Lynne H. Browne
*Assistant Examiner*—Doug Hutton
(74) *Attorney, Agent, or Firm*—Troxell Law Office PLLC

(57) ABSTRACT

A handle assembly of luggage comprises a handle grip with a push button, two first sliding tubes, at least one pair of second sliding tubes, two support tubes, two first locking means each provided below each first sliding tube, at least one pair of second locking means each provided below each second sliding tube, and a flexible steel cable attached between handle grip and first locking means. This ensures a fully extended handle, a significant increase of the ratio of extendible maximum length to retractable minimum length of handle, and the retracted handle grip rested on the bezel without any gap.

6 Claims, 5 Drawing Sheets

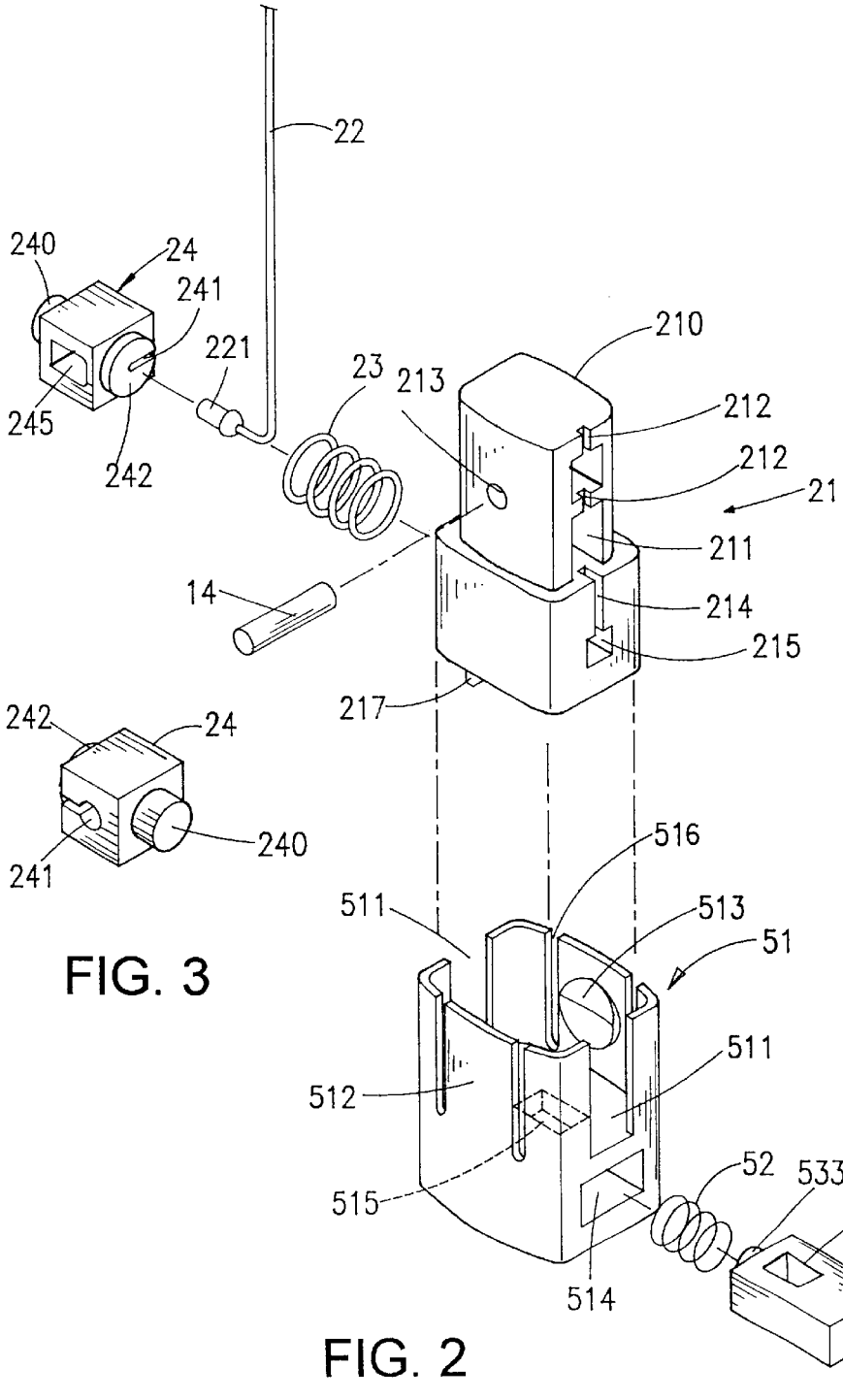
FIG. 3
FIG. 2
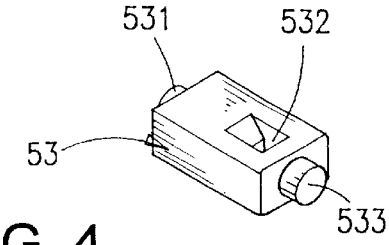
FIG. 4

LOCKING DEVICE FOR HANDLE ASSEMBLY

BACKGROUND OF THE INVENTION

1. Field of the Invention

The present invention relates to a retractable handle for a locking device for a retractable handle of wheeled luggage and more particularly to such a locking device with improved characteristics.

2. Description of Related Art

Typically, a single locking device is provided in the retractable handle for controlling the handle in a retracted position and an extended position. That is, the retractable handle may be extended to a maximum length when towing on the ground by traveler as well as retracted into a minimum length (i.e., rested on the top of luggage) appropriate for stowage or transport. It is known that luggage equipped with a retractable handle is very popular among travelers. Thus many types of luggage with retractable handle are commercially available in which each type of luggage mounted with a unique locking device. For example, the single locking device comprises wedge members, springs, lock blocks (or pins), supporting members, detents, and connecting wires.

Various designs of locking devices have been found in a search as follows: U.S. Pat. No. 5,581,846 entitled "Controlling Handle Structure for Full Rods of a Luggage", and U.S. Pat. No. 5,628,088 entitled "Multistage Adjustable Device for Trunk Bracket". As to the complex retractable handle with multiple retaining slots, various designs thereof also have been found in a search as follows: Taiwanese Patent Published No. 337,100 entitled "Improved Retractable Handle of Luggage"; No. 362,404 entitled "Activation Mechanism for Retractable Handle with Multiple Retaining Slots of Luggage"; and No. 368,815 entitled "Improved Activation Mechanism for Retractable Handle with Multiple Retaining Slots of Luggage". But these are unsatisfactory for the purpose for which the invention is concerned for the following reasons:

1. Complex in structure.
2. Susceptible to breakdown.
3. Time consuming in assembly.
4. A horizontal component force is applied on the slope because connecting wires, detents, and wedges interact with one another when user presses on the push button to activate the locking mechanism through the connecting wires. This horizontal component force may control the activation of lock blocks (or pins) and detents. However, an undesirable gap still exists between a fully retracted handle and the bezel. This is a significant drawback.
5. A horizontal component force is applied on the slope when lock blocks (or pins) are activated by slanted guide groove. This causes additional drawbacks in addition to those described above. In detail, the ratio of extendible maximum length to retractable minimum length is significantly lowered due to the implementation of multiple-segment longitudinal slanted guide groove. This limits the effective length of extended handle. Further, it has the disadvantages of complex in structure, difficult to adjust the assembly, low yield of finished product, and higher manufacturing cost. Thus improvement is desirable.

SUMMARY OF THE INVENTION

It is therefore an object of the present invention to provide a locking device for handle assembly for significantly increasing the ratio of extendible maximum length to retractable minimum length of handle such that a predetermined extendible length is achievable.

It is another object of the present invention to provide a locking device for handle assembly wherein second locking device secures to the bottom of the second sliding tube. The second locking device has three members at most. Further, only a snapping is required to finish the assembly of second locking device and second sliding tube without any fastener. This second locking device has the advantages of simple in structure, quick assembly, and durable.

It is still another object of the present invention to provide a locking device for handle assembly wherein lock member of first locking device is provided at the bottom of first housing of the first locking device capable of directly moving into the lock hole of the second locking device so as to cause lock pin of the second locking device to become disengaged. There is no horizontal component force created on the slope as occurred in the prior art because the lock member of the first locking device directly inserts into the lock hole of second locking device as well as first locking device and second locking device are engaged in a planar surface. This ensures that there is no gap between the first and second locking devices such that the handle grip of the fully retracted handle may rest on the bezel.

To achieve the above and other objects, the present invention provides a locking device for handle assembly comprising: a first sliding tube; a first locking device detachably attached to the bottom of the first sliding tube; a second sliding tube for allowing the first sliding tube to slidingly move therein having a hole; a second locking device detachably attached to the bottom of the second sliding tube; a support tube for allowing the second sliding tube to slidingly move therein having a hole; and a first connecting means connected between a push button and the first locking device.

Whereby the handle is retracted when the push button is not pressed, the first sliding tube is received in the second sliding tube and the second sliding tube is received in the support tube, the projection of the first locking device is engaged with the lower hole of the second sliding tube, the bottom of the first locking device is biased against the top of the sliding block of the second locking device so as to move the lock member of the first locking device into the lock hole of the second locking device to cause the lock pin of the second locking device to retract into the support tube, whereby the handle is locked in a retracted position.

The push button is pressed. Then handle is pulled upward to cause the first locking device to move up so as to move the lock pin of the first locking means into lower hole of the second sliding tube. Grasp handle grip to pull first sliding tube upward for separating the lock member on the bottom of first locking device from lock hole of the second locking device. Then second locking device moves up as the second sliding tube and first sliding tube move up together until the second lock pin comes into contact with upper hole of the support tube and locks therein. Now handle is in a fully extended position for allowing luggage to be towed along the ground.

The above and other objects, features and advantages of the present invention will become apparent from the following detailed description taken with the accompanying drawings.

BRIEF DESCRIPTION OF THE DRAWINGS

FIG. 2 is a greatly enlarged fragmentary view showing the first and second locking devices of FIG. 1;

FIG. 3 is similar to FIG. 2 showing the lock block of first locking device;

FIG. 4 is similar to FIG. 2 showing the lock block of second locking device;

DETAILED DESCRIPTION OF THE PREFERRED EMBODIMENTS

Figure 1:
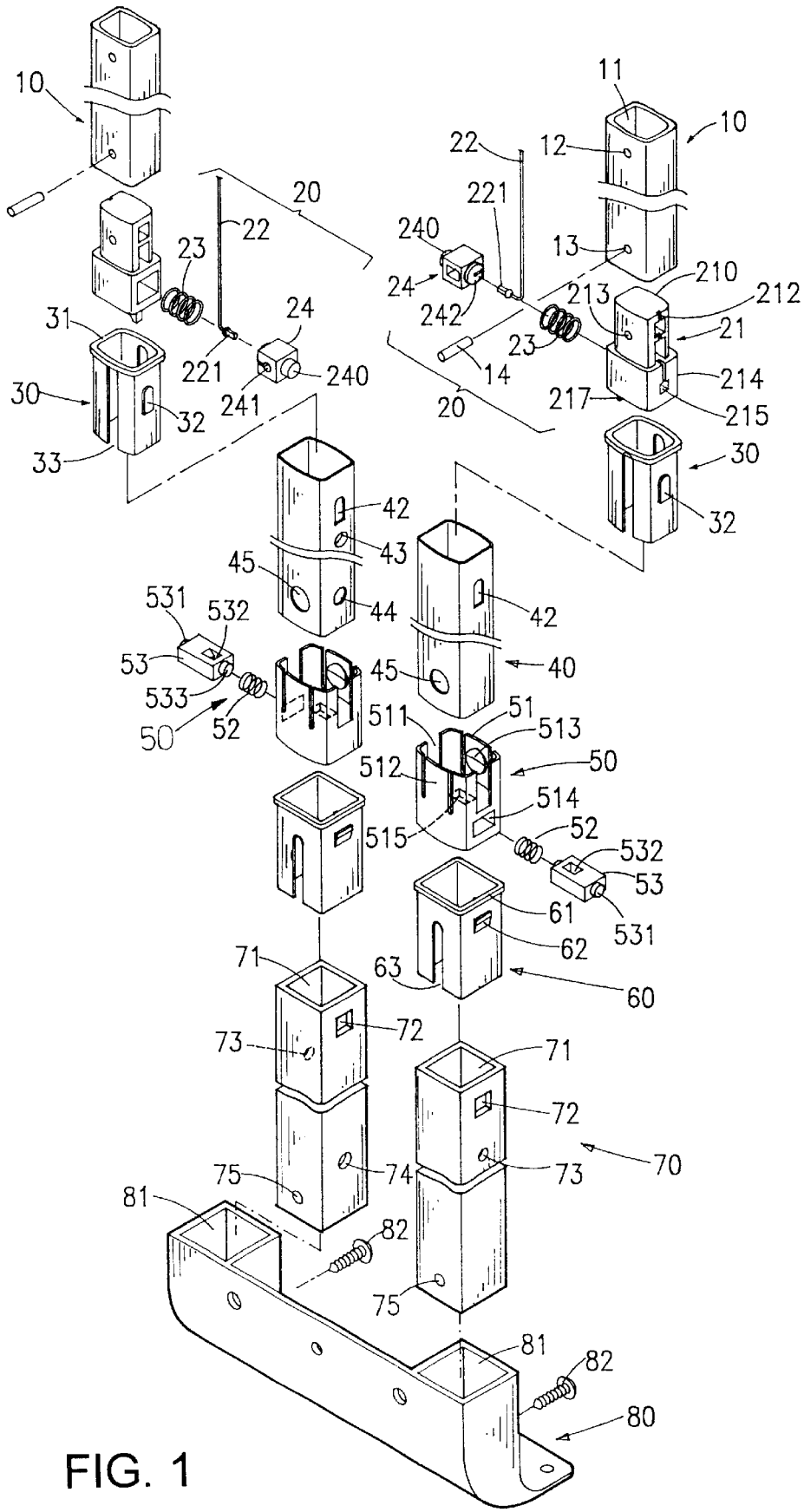
FIG. 1 is an exploded view of a locking device for handle assembly of wheeled luggage of the invention.

Referring to FIGS. 1–4, there is shown a locking device for handle assembly of wheeled luggage constructed in accordance with the invention wherein handle assembly is provided on the back of luggage with a handle grip (not shown) received in a bezel on top of luggage.

Note that because the handle system is bilaterally symmetrical so that description of one side serves to describe the entirety. Thus the handle system of the invention comprises: a first sliding tube 10 having a lower hole 13 and an upper hole 12 attached to one end of handle grip by a known fastener; a first locking device 20 detachably attached to the bottom of first sliding tube 10; a second sliding tube 40 for allowing first sliding tube 10 to slidingly move therein having a top and lower holes 43 and 44 on a first side, an apertures 42 on first side, and a pin hole 45 on a second side; a first sleeve member 30 provided on the top of second sliding tube 40 having two detents 32 provided on two opposing sides matingly engaged with apertures 42 of second sliding tube 40; a second locking device 50 detachably attached to pin hole 45 of the second sliding tube 40 by a projection 513; a support tube 70 for allowing second sliding tube 40 to slidingly move therein having a top and lower holes 73 and 74 on a first and third sides, two apertures 72 on a second and third sides; and a second sleeve member 60 provided on the top of support tube 70 having two detents 62 provided on two opposing sides matingly engaged with apertures 72 of support tube 70.

The first locking device 20 comprises a first housing 21 having an upper portion 210 with a guide groove 212 and a pin hole 213 such that pin 14 may insert through lower hole 13 of first sliding tube 10 and pin hole 213 to secure first locking device 20 and first sliding tube 10 together; and a lower portion 214 with a cavity 215 (FIG. 2); a spring 23 provided in the cavity 215 of first housing 21; a lock block 24 provided in the cavity 215 of first housing 21 having a projection 240 on a first side, an aperture 241 on a second side, and an opening 245 in communication with the aperture 241; a lock member 217 provided on the bottom of first housing 21; and a flexible steel cable 22 having an enlargement on one end (not shown) being secured to handle grip and an enlargement 221 on the other end being secured in the opening 245 through the guide groove 212, cavity 215 (FIG. 2), and aperture 241 such that a pressing of the push button may be transmitted to first locking device 20 through the movement of flexible steel cable 22.

The second locking device 50 comprises a second housing 51, spring 52, and second lock block 53 wherein the upper portion of the second housing 51 having a plurality of slots 516, two opposing recesses 511, and a lock hole 515 wherein a projection 513 is protruded inwardly on two opposite inner surfaces of flexible member 512 formed therebetween slots 516, the projection 513 may engage with pin hole 45 of second sliding tube 40; the lower portion of the second housing 51 having a cavity 514 for receiving the second lock block 53 being in communication with lock hole 515 in the recess 511; and a projection 533 is protruded on one end of second lock block 53 for putting spring 52 thereon and a lock pin 531 is protruded on the other end of second lock block 53.

The following is a description of the operation of handle assembly.

Figure 6B:
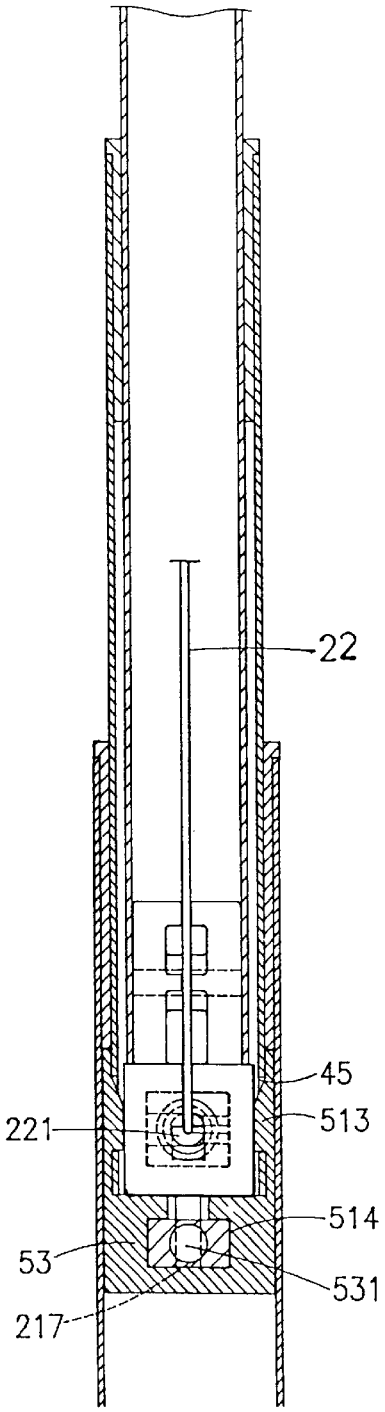
FIGS. 6A and 6B are first and second sectional views of first and second locking devices where second locking device is pressed by first locking device and handle is being retracted.
Figure 6A:
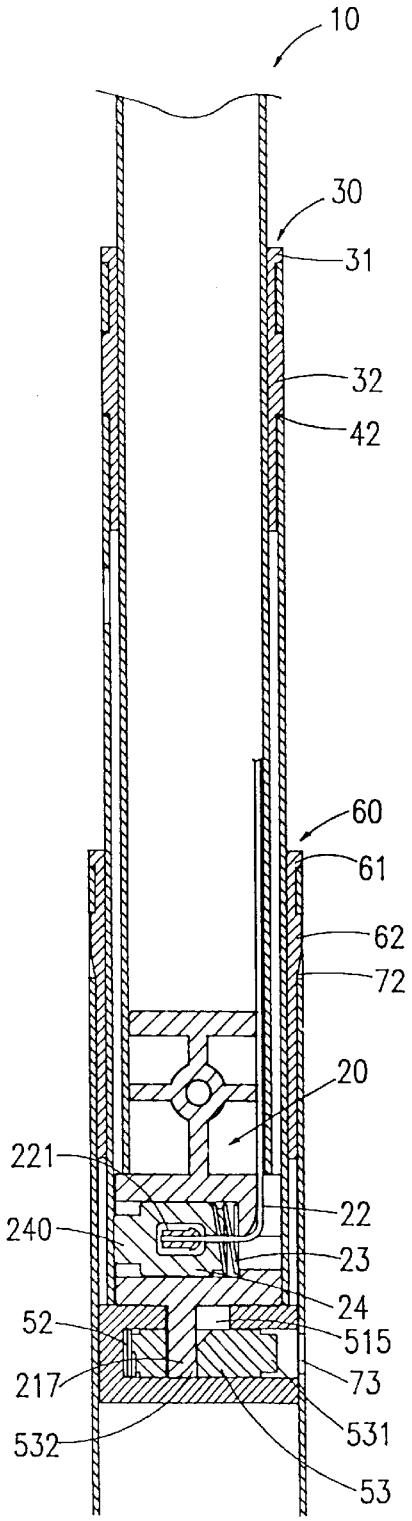
Figure 7B:
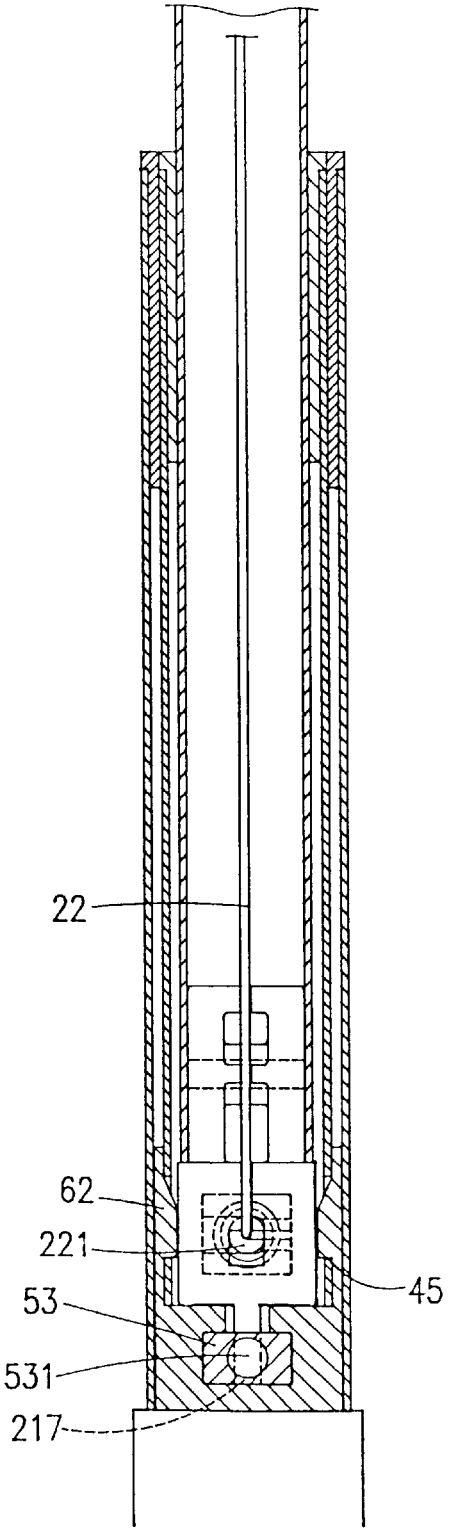
FIGS. 7A and 7B are first and second sectional views of first and second locking devices where handle is retracted to its lowest position.
Figure 7A:
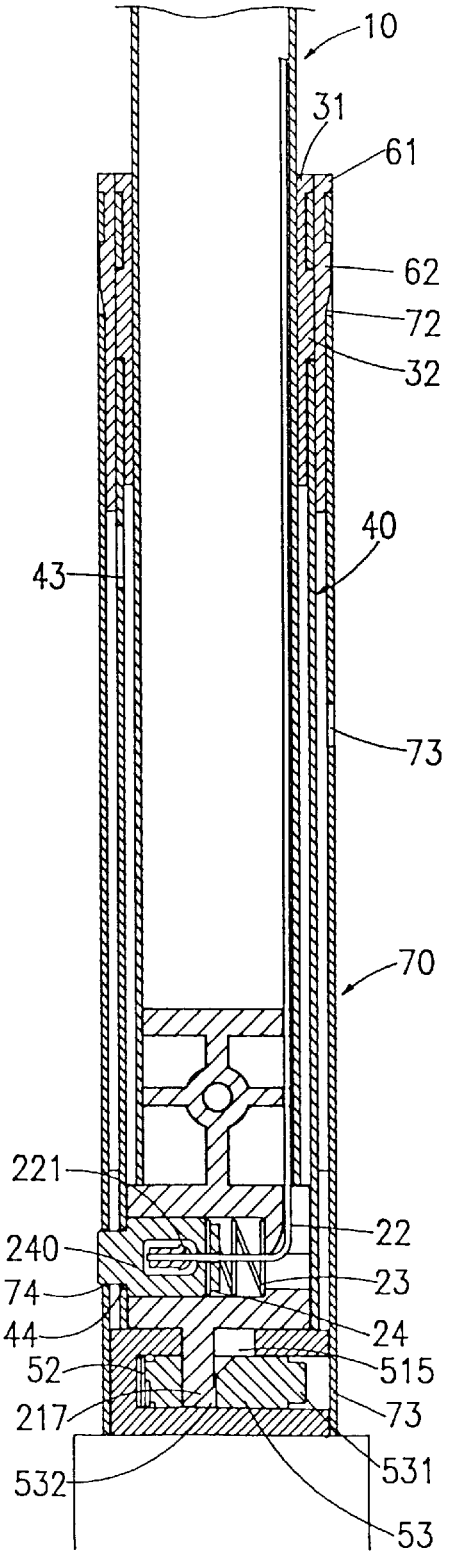

Referring to FIGS. 1–7, handle is retracted when push button (not shown) is not pressed (FIGS. 7A and 7B). First sliding tube 10 is received in second sliding tube 40 and second sliding tube 40 is received in support tube 70. Projection 240 is biased by spring 23 to engage with lower hole 44 of second sliding tube 40 and lower hole 74 of the support tube 70. The lock member 217 at the bottom of the first locking device 20 is biased against the lock hole 515 of the second locking device 50 so as to retract the lock block 53 of the second locking device 50 into the support tube 70, whereby the handle is locked in a retracted position.

Figure 5B:
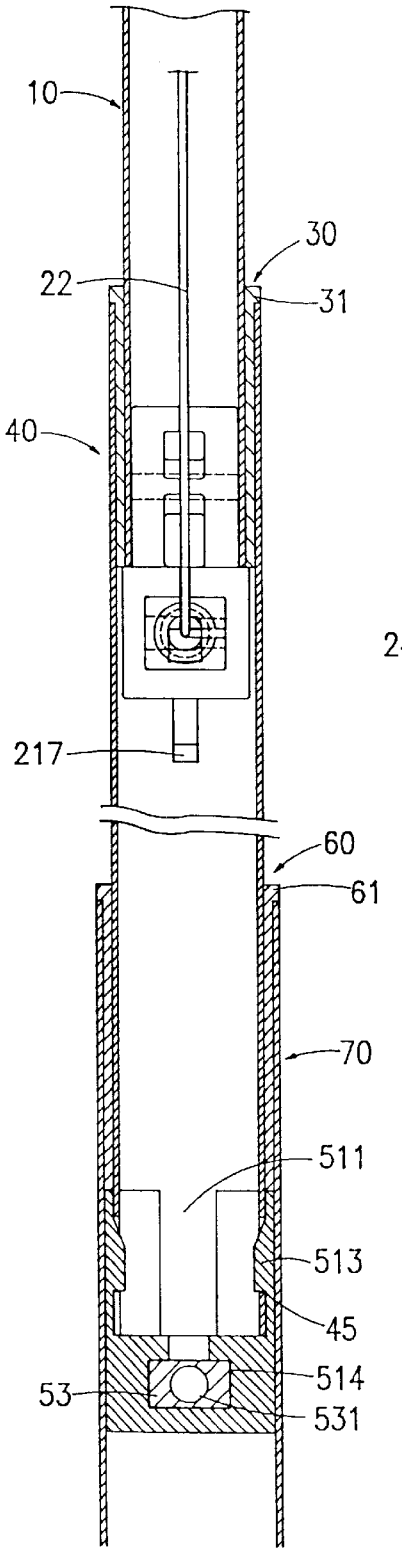
FIGS. 5A and 5B are first and second sectional views of first and second locking devices where handle is fully extended.
Figure 5A:
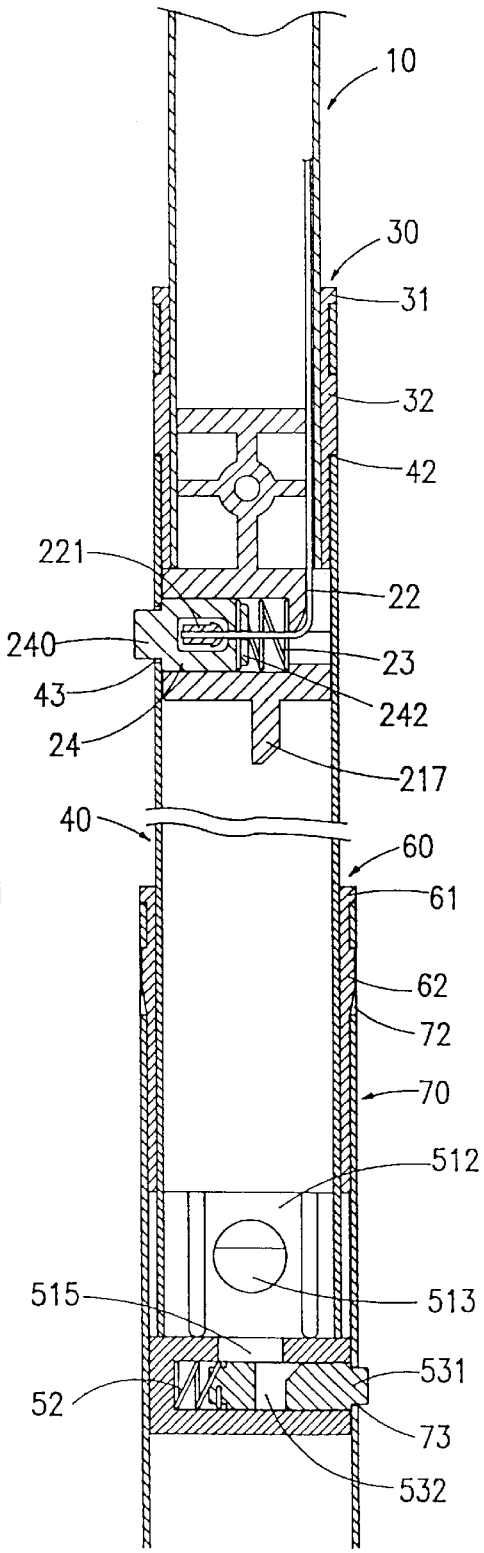

The push button is pressed (FIGS. 6A and 6B). Then handle is pulled upward. That is, flexible steel cable 22 of the first locking device 20 is moved up so as to bias spring 23 of the first locking device 20. Further, lower hole 44 of projection 240 of lock block 24 clears lower hole 44 of second sliding tube 40 and lower hole 74 of support tube 70 (FIG. 6A). As such, grasp handle grip to pull first sliding tube 10 upward for separating the lock member 217 at the bottom of first locking device 20 from lock hole 515 of the second locking device 50. Then lock block 53 of the second locking device 50 retract into the upper hole 73 of support tube 70 and secured therein (FIGS. 7A and 7B). Once first sliding tube 10 is pulled up to cause projection 240 of lock block 24 of first locking device 20 to come into upper hole 43 of the second sliding tube 40 to lock therein (FIGS. 5A and 5B). Now handle is in a fully extended position for allowing luggage to be towed along the ground. To the contrary, press push button to retract handle which in turn causes pin 240 of lock block 24 attached to cable 22 to escape engagement with upper hole 43 of second sliding tube 40. Whereby first sliding tube 10 may receive within second sliding tube 40 until lock member 217 at the bottom of first locking device 20 comes into contact with the lock hole 515 of the second locking device 50. This causes lock pin 53 of second locking device 50 to clear upper hole 73 of support tube 70 (FIGS. 6A and 6B). Pin 240 of the lock block 24 of the first locking device 20 clears upper hole 43 of second sliding tube 40 when push button is pressed again. Then first sliding tube 10 may receive in second sliding tube 40 and second sliding tube 40 may receive in support tube 70. Now the handle is fully retracted (FIGS. 7A and 7B).

Note that the first locking device 20 is a master device and second locking device 50 is a slave one. As such, the number of second locking device 50 may be added in other embodiments. Further, the number of second sliding tube 40 with a number of second locking device 50 having a lock member 217 at the bottom of second locking device 50 (except the lowest one) may be added too. As a result, a handle assembly with multiple locking devices and a plurality of constituent tubes are carried out, thereby enabling handle to extend and lock in one of a plurality of selective positions thereof.

While the invention herein disclosed has been described by means of specific embodiments, numerous modifications and variations could be made thereto by those skilled in the art without departing from the scope of the invention set forth in the claims.

What is claimed is:

1. A handle assembly provided on a luggage movable between extended and retracted positions and comprising:

a pair of first sliding tubes;

a pair of first locking means each detachably attached to a bottom of one of the first sliding tubes and including a first lock pin, a first lock block, and a lock member extending therefrom;

a pair of second sliding tubes each having one of the first sliding tubes slidingly movable therein, and each having a first lower hole, a first upper hole and a pin hole;

a pair of second locking means each detachably attached to a bottom of one of the second sliding tubes and including a second lock pin, a second lock block, and a lock hole corresponding to the lock member of the first locking means;

a pair of support tubes each having one of the second sliding tubes slidingly movable therein and having a second upper hole; and a pair of steal cables each connected to and extending from the first locking means, whereby when the handle assembly is in the retracted position, a bottom of each of the first locking means is biased against a top of each of the second locking means so as to move the lock member of each of the first locking means into the lock hole of each of the second locking means to cause the second lock block of each of the second locking means to retract into each of the support tubes, the first lock block of each of the first locking means is engaged with the first and second lower holes of each of the second sliding tubes and support tubes thereby locking the handle in a retracted position, and when the handle is in the extended position, the connecting means activates the first locking means so as to move the first lock pin of each of the first locking means into the first lower hole of each of the second sliding tubes, enabling each of the first sliding tubes to be extended for separating the lock member of each of the first locking means from the lock hole of each of the second locking means, thus enabling each of the second locking means to move as each of the second sliding tubes and first sliding tubes are extended until the second lock pin of each of the second locking means engages the second upper hole of each of the support tubes and each of the first locking means engages the first upper hole of each of the second sliding tubes, whereby the handle is in a fully extended position.

2. The handle assembly of claim 1, wherein each of the second locking means comprises a housing, a spring, and a second lock block.

3. The handle assembly of claim 1, wherein each of the first locking means comprises a housing with a cavity having a spring provided therein, and the first lock pin of each of the first locking means is provided in the housing.

4. The handle assembly of claim 1, wherein the first lock block of each of the first locking means is receivable in each of the second locking means.

5. The handle assembly of claim 2, wherein an upper portion of the housing has a plurality of slots, two opposing recesses, and a projection formed between the slots protruding inwardly on two inner opposite surfaces thereof and being engaged with the pin hole of each of the second sliding tubes.

6. The handle assembly of claim 2, wherein a lower portion of the housing has a transverse cavity receiving each of the second lock blocks and is in communication with the lock hole of each of the second locking means, a protrusion projecting from a first end of the second lock block of each of the second locking means with a spring thereon, and a lock pin protruding from a second end of second lock block of the second locking means.

* * * * *